US006098510A

United States Patent [19]

Hada et al.

[11] Patent Number: 6,098,510

[45] Date of Patent: Aug. 8, 2000

[54] METHOD AND APPARATUS FOR SLITTING A SHEET MATERIAL WEB

[75] Inventors: Frank S. Hada, Appleton, Wis.; Randall J. Le Valley, Marysville, Wash.; James M. Perkins; Lowell E. Thoms, both of Appleton, Wis.

[73] Assignee: Kimberly-Clark Worldwide, Inc., Neenah, Wis.

[21] Appl. No.: 08/934,346

[22] Filed: Sep. 19, 1997

[51] Int. Cl.[7] ..... B65H 35/02

[52] U.S. Cl. ..... 83/13; 83/358; 83/425; 83/508.2; 83/949; 242/525.2

[58] Field of Search ..... 242/525.2; 83/649, 83/544, 504, 100, 425, 425.2, 425.3, 425.4, 56, 949, 358, 508.2, 13

[56] References Cited

U.S. PATENT DOCUMENTS

| | | | |
|---|---|---|---|
| 365,796 | 7/1887 | Colley | 242/525.2 |
| 480,111 | 8/1892 | Manning | 242/524 |
| 484,173 | 10/1892 | Brown | 242/419.9 |
| 577,865 | 3/1897 | Koegel | 242/525.2 |
| 610,329 | 9/1898 | Meisel | 242/525.2 |
| 851,015 | 4/1907 | Meisel | 242/525.2 |
| 1,026,482 | 5/1912 | White | 242/525.2 |
| 1,354,464 | 10/1920 | Cameron et al. | 242/525.2 |
| 2,621,736 | 12/1952 | Scruggs et al. | 242/524.1 |
| 3,058,685 | 1/1962 | Kistler | 242/525.6 |
| 3,226,049 | 12/1965 | Corbett | 242/525.2 |
| 3,304,020 | 2/1967 | Fleenor | 242/524.1 |
| 3,585,980 | 6/1971 | Mellor | 125/13 |
| 3,977,627 | 8/1976 | Sundin | 242/525.2 |
| 4,695,006 | 9/1987 | Pool | 242/56.3 |
| 5,591,309 | 1/1997 | Rugowski et al. | 162/283 |
| 5,593,545 | 1/1997 | Rugowski et al | 162/207 |
| 5,655,583 | 8/1997 | Heintzeman | 144/204.2 |
| 5,794,500 | 8/1998 | Long et al. | 83/22 |

FOREIGN PATENT DOCUMENTS

| | | | |
|---|---|---|---|
| 649805 | 10/1962 | Canada | 242/525.2 |
| 1519435 | 3/1968 | France . | |
| 2143262 | 2/1973 | France . | |
| 2289315 | 5/1976 | France . | |
| 2596374 | 10/1987 | France . | |
| 30 40 500 A1 | 6/1982 | Germany . | |
| 86 00 460 U | 2/1986 | Germany . | |
| 354141476A | 11/1979 | Japan | 242/525.2 |
| 814351 | 6/1959 | United Kingdom . | |
| 2 122 941 | 1/1984 | United Kingdom . | |
| WO 86/03445 | 6/1986 | WIPO . | |

OTHER PUBLICATIONS

Article—Mannesman Rexroth Star Linear Systems—"Linear Modules MKK . . . with Sealing Strip," (Precision in Motion™, RA 82 411/10.96) (22 pg.).

Article—"Motion Control Will Never Be the Same"—1394 Digital, AC, Multi–Axis Motion Control System (Rockwell Automation Allen–Bradley—Pub. 1394—1.0—Jan. 1997).

*Primary Examiner*—M. Rachuba
*Assistant Examiner*—Stephen Choi
*Attorney, Agent, or Firm*—Brinks Hofer Gilson & Lione

[57] ABSTRACT

An apparatus for slitting a sheet material web as it is wound onto a roll including at least one winding drum supporting the web, a moveably reel spool positioned in a parallel and spaced apart relationship with the winding drum, a slitting device and a control system. The slitting device includes a track member and a slitting member moveably mounted on the track member. The slitting member continuously slits the sheet material web longitudinally along its length as it is wound onto the roll. The control system controls the position of the slitting member on the track so as to maintain a predetermined penetration of the slitting member within the roll as the roll increases in size. A method for continuously slitting the roll includes carrying the sheet material web over a winding drum, depositing the sheet material web onto a rotating reel spool to form a roll of sheet material web, moving the slitting member so as to continuously slit the sheet material web on the roll and controlling the movement of the slitting member with a control system so as to maintain a predetermined depth of penetration of the slitting member within the roll.

40 Claims, 9 Drawing Sheets

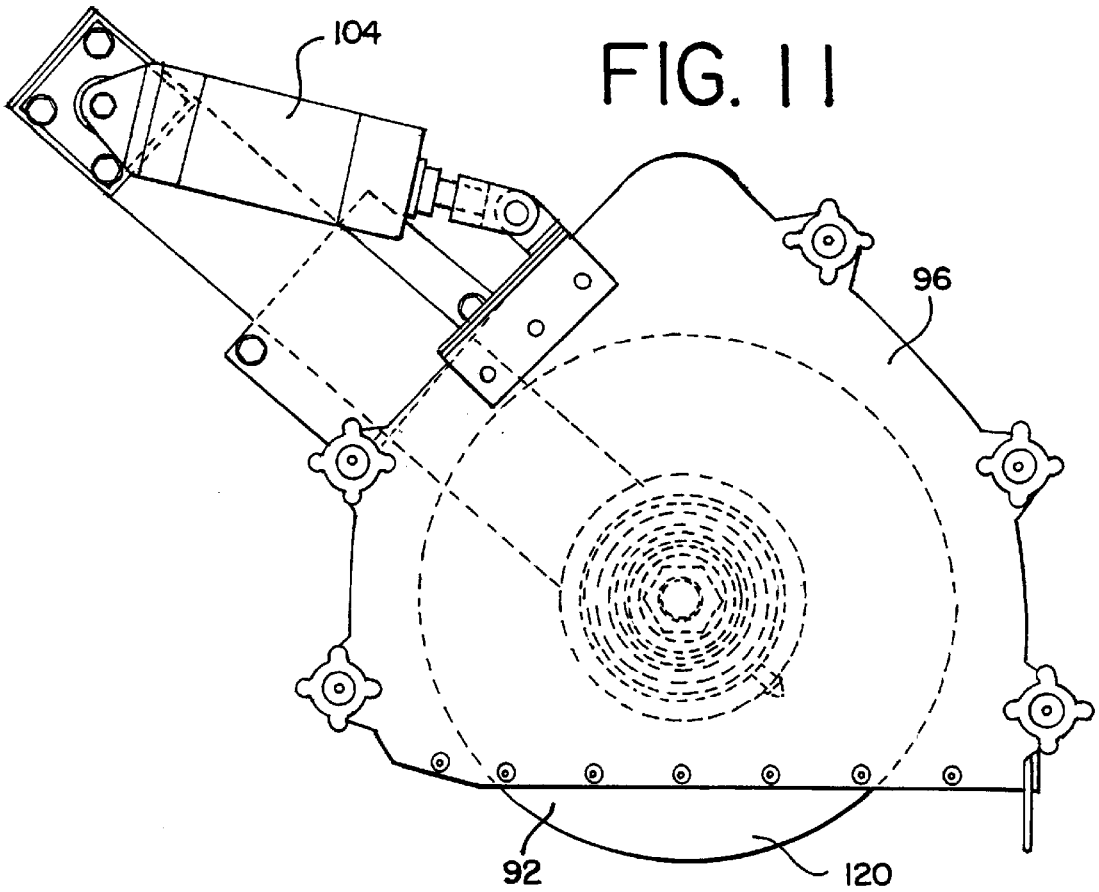
FIG. 11
FIG. 12
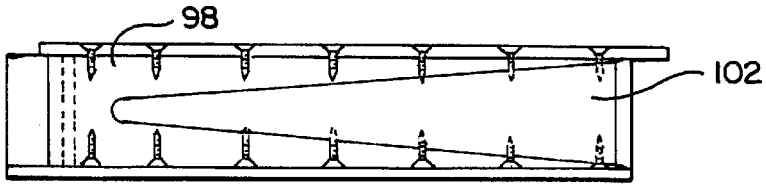
FIG. 13
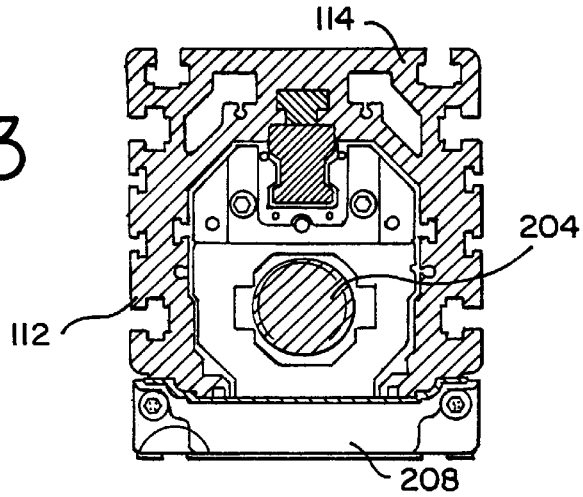

METHOD AND APPARATUS FOR SLITTING A SHEET MATERIAL WEB

BACKGROUND OF THE INVENTION

The present invention relates generally to a method and apparatus for slitting a sheet material web, and in particular, to a method and apparatus for slitting a sheet material web being wound on a roll.

It is well known in the field of paper making, and particularly in the field of manufacturing tissue products such as facial tissues, bath tissues and paper towels, to provide an apparatus for longitudinally slitting a continuously running sheet material web into two or more strips. Typically, the sheet material web is slit either as it traverses an "open draw" before being wound into rolls, before it is dried or after it is wound onto the roll. In the first instance, the area of open draw, where the dried sheet is momentarily unsupported before being wound, provides an ideal place to slit the web. In particular, the slitting device, often configured as a rotary saw blade, can be applied to the web without concern about cutting or otherwise damaging an underlying fabric, which otherwise carries the sheet material web throughout the forming process. Fabrics of this nature can be expensive and difficult to replace.

However, as described in U.S. Pat. No. 5,591,309, issued Jan. 7, 1997 to Rugowski et al., and assigned to Kimberly-Clark Corporation, the same assignee as the present application, open draws are a frequent source of sheet breaks and associated production delays. As a result, tissue sheets often are designed to have high machine direction strengths in order to remain intact as they are pulled through the open draw. However, high machine direction strengths can adversely affect the quality of the web in terms of its desired softness. Therefore, as explained in U.S. Pat. No. 5,591,309, the elimination of open draws in tissue manufacturing can result in a sheet material being made more efficiently at less cost and with more desirable properties.

When the open draw is eliminated, the sheet material web is typically slit using a water jet prior to drying the web. However, such "wet slitting" can result in a degradation of the throughdrying fabric as it is exposed to hot air passing through the slit in the sheet material during the drying stage of the process. Moreover, the slit edges of the sheet material web may not dry evenly due to the pile up of fibers along the slit. Additionally, when the sheet material web is slit prior to drying, the various strips of sheet material web are difficult to control and can become inadvertently interwoven, or overlapped, as they are further carried towards the winding drum and reel spool. Interwoven strips can be more easily damaged and can make the winding process particularly difficult. Moreover, adjacent rolls having interwoven webs can be particularly difficult to separate. Accordingly, the strips of sheet material web are typically required to be spread apart so as to prevent interweaving.

In contrast to slitting the web prior to drying, it is also known in the art to slit the sheet material web as it is wound onto the roll. Slitting apparatuses of this nature typically apply a pressure or guide roller, or like device, to the outermost surface of the roll so as to thereby control the penetration of the slitting device. However, facial and bath tissues typically have relatively low densities, and hence low resistance to compressive forces. Accordingly, it usually is not desirable, or even possible, to allow such a guide roller to contact the roll as it builds so as to thereby control the position of the slitter, and the penetration thereof

SUMMARY OF THE INVENTION

Briefly stated, the invention is directed to an apparatus for slitting a sheet material web as it is wound onto a roll. The apparatus includes a slitting device having a track member and a slitting member moveably mounted on the track member. The slitting device is supported adjacent to a roll of sheet material web. The apparatus includes at least one winding drum which supports the sheet material web and a moveable reel spool which is positioned in a parallel, spaced apart relationship with the winding drum. The sheet material web is deposited on the reel spool which moves away from the winding drum as the diameter of the roll formed thereon increases. A control system connects the track member and reel spool and is adapted to move the slitting member on the track member in relation to the position of the reel spool relative to the at least one winding drum so as to maintain the predetermined depth of penetration of the slitting member within the roll. In this way, the control system controls the depth of penetration of the slitting member within the roll as it increases in size so as to maintain the desired penetration of the slitting member within the roll but without the control system or track contacting an outer surface of the roll.

In one aspect of the invention, the slitting device includes a carriage which is moveably mounted on a laterally extending support member. In operation, the operator can move the carriage laterally along the length of the cross member to alter the position of the slit in the sheet material web, or to provide access to the slitting device.

In a preferred embodiment, the track member is pivotally attached to the support member about a horizontal axis. In operation, the track member can be pivoted about the axis to maintain the penetration of the slitting member within the roll, or to move the slitting device completely out of the path of the roll, reel spool or supporting structure.

In yet another aspect, a method is provided for continuously slitting the sheet material web as it is wound onto a roll. The method includes the steps of carrying the web over a winding drum in a longitudinal direction, depositing the web onto a rotating reel spool to form a roll, making a plunge cut with a slitting member to slit the roll after a predetermined number of initial layers are formed on the roll, moving the reel spool relative to the winding drum as the size of the roll increases and moving the slitting member relative to the position of the reel spool so as to continuously slit the web on the roll while maintaining a predetermined depth of the slitting member within the roll.

The present invention provides significant advantages over other slitting devices. Importantly, the apparatus allows for slitting the sheet material web while it is being wound onto a roll. In this way, the open draw of the forming process can be eliminated so as to reduce waste and improve the quality of the sheet material, but without having to slit the web prior to the drying process, wherein the problems of fabric degradation, fiber build-up at the slit edges and loss of sheet control can be encountered.

Moreover, the apparatus provides for an improved, cleaner cut as compared with webs slit over an open draw because the sheet material web is supported by the underlying layers of web already wound onto the roll. Moreover, since the web is slit as it is wound onto the roll, the problem of interweaving is thereby eliminated, and the rolls can be easily separated.

In addition, the present invention provides an improved method and apparatus for slitting the web on the roll. In particular, the track and control system provide a unique way of maintaining the desired penetration of the blade within the roll without using a guide roller or similar device to contact the outer surface of the roll. This is especially important with the manufacture of tissue rolls wherein the density of the web is relatively low and the roll is less capable of reliably supporting a guide roller. Moreover, bathroom tissue and the like are formed from a relatively fragile sheet material web which can be more easily damaged by contact with a guide roller or similar device.

In addition, since the track and slitting member are not dependent upon or linked to the surface of the roll, and the penetration of the slitting member is not controlled thereby, the penetration of the slitting member can be independently adjusted. In this way, the slitting member can be moved to provide an initial plunge cut in the roll after a predetermined number of initial layers are wound onto the roll, and the depth of the penetration can be easily adjusted to account for varying thicknesses of the sheet material web. The capability to provide a plunge cut through the use of a programmable controller greatly simplifies the mechanism. Moreover, by providing a pivotal attachment, the slitting member can be easily and quickly moved away from the roll if slitting is not desired, in the event of a sheet break or for various other reasons such as avoiding overhead support structure while laterally moving the track above the roll of sheet material.

Additionally, the apparatus can easily be moved laterally to any desired position above the longitudinally moving web, or can be moved completely to the side of the operating line so as to be accessible to the operator for blade changes and the like. Alternatively, a plurality of slitting apparatuses can be positioned above the web so as to enable the operator to make multiple strips of sheet material web. In either situation, the desired slitting operation can be set up quickly, inexpensively and with little or no waste.

Furthermore, the use of a single track overlying the roll eliminates the need for parallel tracks on opposite sides of the roll, and thereby avoids the possibility of binding within the tracks and reduces the overall cost of making and maintaining the apparatus.

The present invention, together with further objects and advantages, will be best understood by reference to the following detailed description taken in conjunction with the accompanying drawings.

BRIEF DESCRIPTION OF THE DRAWINGS

Many of the features and dimensions portrayed in the drawings, and in particular the presentation of sheet material web thicknesses and the like, have been somewhat exaggerated for the sake of illustration and clarity.

FIG. 11 is an enlarged partial side view of the slitting device.

FIG. 12 is an enlarged bottom view of the guard.

FIG. 13 is a cross sectional view of the track member.

DETAILED DESCRIPTION OF THE PRESENTLY PREFERRED EMBODIMENTS

It should be understood that the term "web," as used herein, is meant to include a sheet material made of one or more plies of material so that a multiple-ply sheet material is considered to be a "web" of sheet material, regardless of the number of plies. In addition, the term "longitudinal," as used herein, is intended to indicate the direction in which the web traverses through the forming process in the machine direction, and is not intended to be limited to a particular length of the web, whether it is cut or otherwise. Similarly, the terms "downwardly," "upwardly," "forward", "rearward", "left" and "right" as used herein are intended to indicate the direction relative to the views presented in the Figures, and in particular, from a perspective when viewing the web and fabric as they travel away from the drier toward the slitting apparatus and ultimately to the reel spool.

Figure 1:
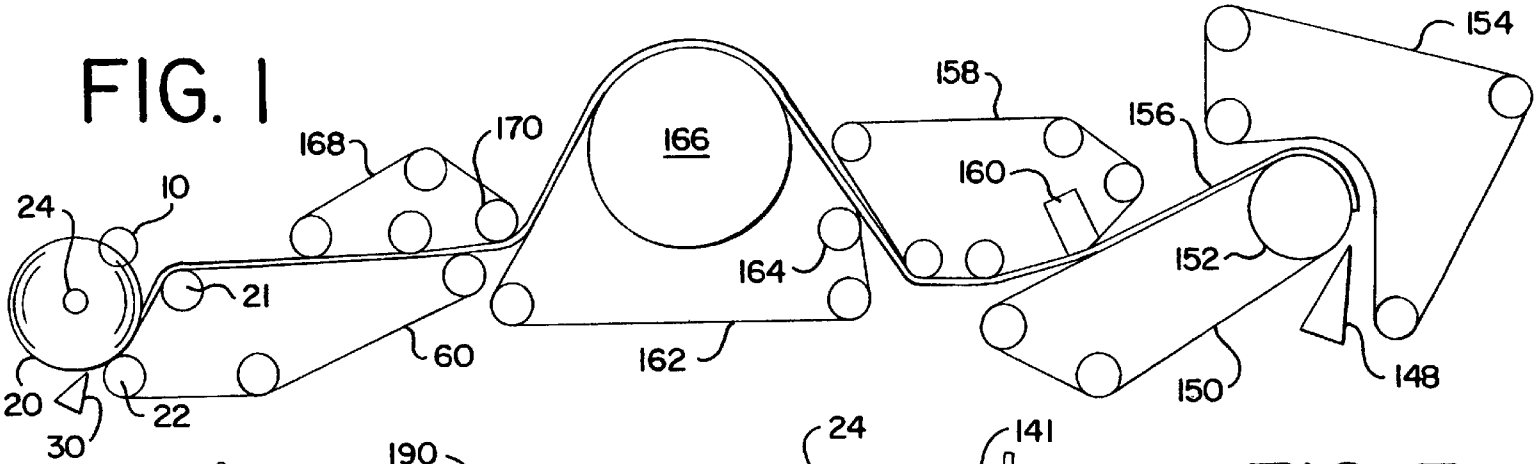
FIG. 1 is a schematic process flow diagram of a method for making soft high bulk tissue sheets in accordance with this invention.

Referring to FIG. 1, a schematic diagram for forming a sheet material web without an open draw is shown. The apparatus and method for making such a web is set forth in U.S. Pat. No. 5,593,545, issued Jan. 14, 1997, U.S. Pat. No. 5,591,309, issued Jan. 7, 1997, and U.S. application Ser. No. 08/887,922, entitled Uniformly Wound Rolls of Soft Tissue Sheets Having High Bulk, filed Jul. 3, 1997, and assigned to Kimberly-Clark Corporation, the assignee of the present application, all of which are herein incorporated by reference. However, it should be understood by one of skill in the art that the present invention could be used with other paper forming processes which utilize fabrics and/or belts to carry a sheet material web, with or without an open draw, and can be used for slitting other types of sheet materials other than paper products.

As explained in U.S. Pat. Nos. 5,593,545 and 5,591,309, and application Ser. No. 08/887,892, and as shown in FIG. 1, a representative throughdrying process for making uncreped throughdried tissues is shown. Shown is the headbox 148 which deposits an aqueous suspension of papermaking fibers onto inner forming fabric 150 as it traverses the forming roll 152. Outer forming fabric 154 serves to contain the web while it passes over the forming roll and sheds some of the water. The wet web 156 is then transferred from the inner forming fabric to a wet end transfer fabric 158 with the aid of a vacuum transfer shoe 160. This transfer is preferably carried out with the transfer fabric traveling at a slower speed than the forming fabric (rush transfer) to impart stretch into the final sheet material web. The wet web is then transferred to the throughdrying fabric 162 with the assistance of a vacuum transfer roll 164. The throughdrying fabric carries the web over the throughdryer 166, which blows hot air through the web to dry it while preserving bulk. There can be more than one throughdryer in series (not shown), depending on the speed and the dryer capacity. The dried tissue sheet is then transferred to a first dry end transfer fabric 168 with the aid of vacuum transfer roll 170. The sheet material web shortly after transfer is sandwiched between the first dry end transfer fabric and the transfer belt 60, or fabric, to positively control the sheet path. The air permeability of the transfer belt 60 is lower than that of the first dry end transfer fabric, causing the sheet to naturally adhere to the transfer belt. At the point of separation, the sheet follow the transfer belt due to vacuum action. Suitable fabrics for use as the first dry end fabric include without limitation, a wide variety of fabrics such as Asten 934, Asten 939, Albany 59M, Albany Duotex DD207, Lindsay 543 and the like.

After the sheet material web is compressed between the first dry end transfer fabric and the second dry end transfer fabric 60, which, in one embodiment, has a greater air permeability than that of the first dry end transfer fabric, the web is wrapped around the winding drum 21. Suitable low permeability fabrics for use as transfer belts, or fabrics, include, without limitation, COFPA Monocap NP 50 dyer felt (air permeability of about 50 cubic feet per minute per square foot) and Asten 960C (impermeable to air). The transfer belt 60 passes over the two winding drums 21 and 22 before returning to pick up the dried tissue sheet again. The sheet is transferred to the parent roll 20, or building roll, at a point between the two winding drums. Alternatively, as shown in U.S. Pat. Nos. 5,593,545 and 5,591,309, the assembly includes only a single winding drum located adjacent the reel spool. In such an embodiment, the sheet passes through the winding nip between the winding drum and the reel spool and is wound into a roll of tissue for subsequent converting, such as slitting, cutting, folding and/or packaging. In either embodiment, the parent roll is wound onto reel spool 24, which is driven by a motor.

Referring to FIGS. 2–3 and 17–18, the transfer and winding of the sheet is illustrated in more detail. In the free span between the two winding drums 21, 22, the sheet 100 contacts and transfers to the parent roll 20. Reference numbers 24, 24' and 24" illustrate three position of the reel spool during continuous operation with the roll shown in phantom. As shown, a new reel spool 24" is ready to advance to position 24' as the parent roll is building. When the parent roll has reached its final predetermined diameter, the new reel spool is lowered by arm 27 into position 24' against the incoming sheet at some point along the free span between the winding drums, generally relatively close to the first winding drum 21, thereby avoiding a hard nip between the winding drum and the reel spool. The reel spool 24 is supported appropriately by carriages 200, 402. As the parent roll builds, the reel spool 24 moves toward the other winding drum 22 while at the same time moving away from the transfer belt 60.

The reel spool 24 can be moved in either direction as illustrated by the double-ended arrow to maintain the proper transfer belt deflection needed to minimize the variability of the sheet properties during the winding process. As a result, the parent roll nip substantially traverses the free span as the roll builds to its predetermined size, or diameter. At the appropriate time, one or more air jets 30, shown in FIG. 1, serve to blow the sheet back toward the new reel spool 24' in order to attach the sheet to, or deposit it on, the new reel spool by vacuum suction from within the reel spool. As the sheet is transferred to the new reel spool, the sheet is broken and the parent roll is kicked out to continue the winding process with a new reel spool.

As shown in FIGS. 2–3 and 17–18, the reel spool 24 includes a circumferential groove 401 near each end which is rotatably supported on a pair of rails 400. The ends of the reel spool 24 are each operably engaged by a carriage, including a drive carriage 200 and a back carriage 402 which move the reel spool longitudinally along the length of the rails. A support 404, 406 is provided beneath each carriage and supports the carriages with linear bearings 408. A motor 410 is operably connected to a reducer 412, both of which are supported on the drive carriage 200. The reducer 412 includes a retractable gear which extends to operably engage a gear coaxially mounted in the end of the reel spool. In operation, the motor rotates the reducer gear so as to thereby rotate the reel spool. A pair of hydraulic cylinders 202 is mounted to the rail, or similar frame member, and is operably connected to the carriages 200 and 402.

Figure 3:
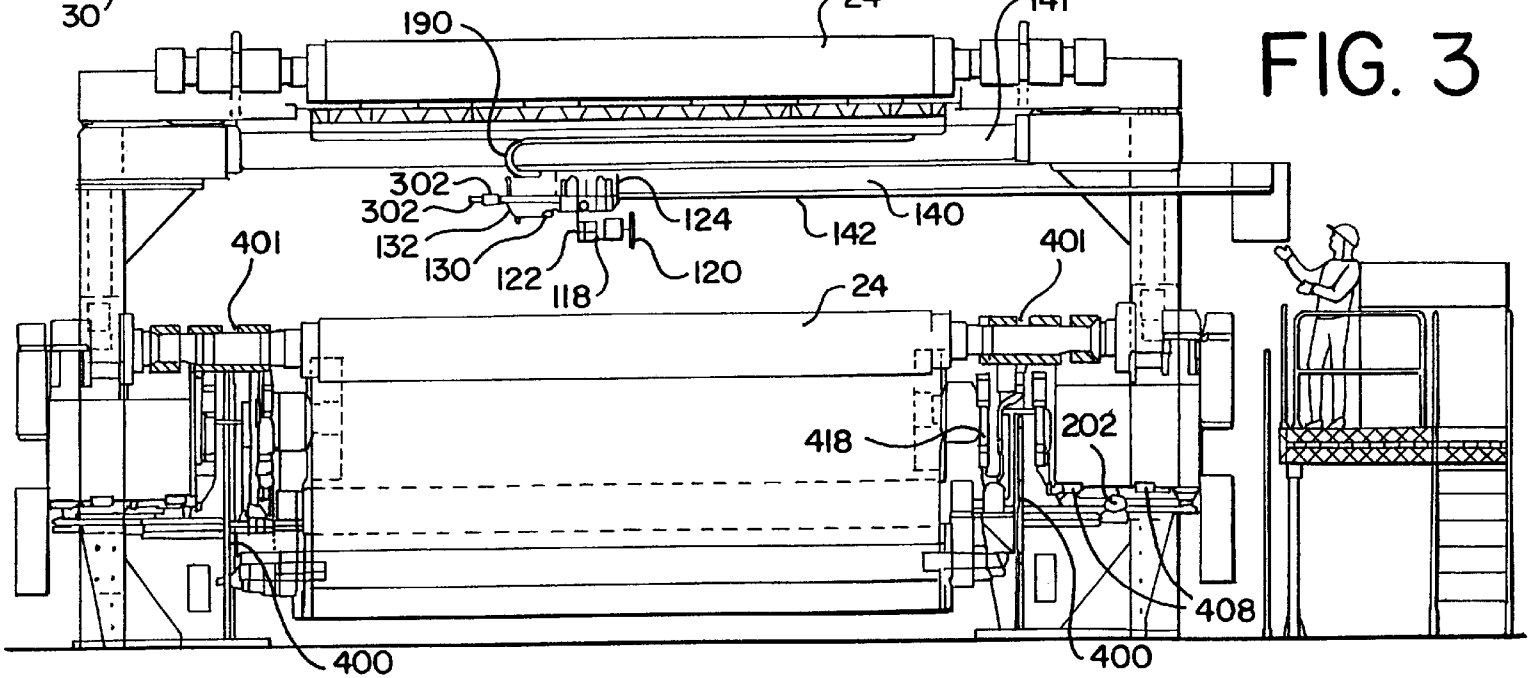
FIG. 3 is a front view of the slitting apparatus shown in FIG. 2.
Figure 17:
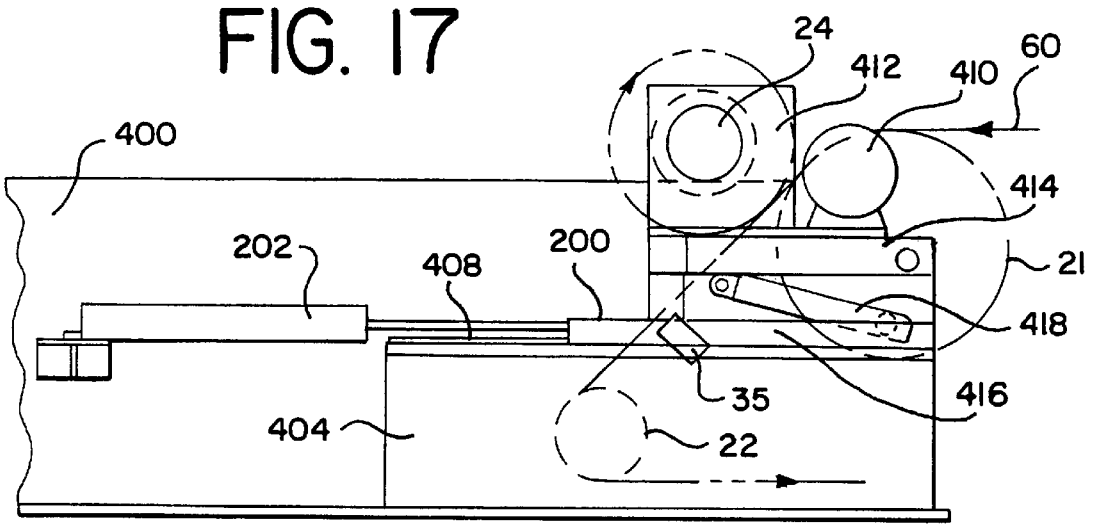
FIG. 17 is a partial side view of the reel spool and winding drum without the slitting device applied thereto.
Figure 18:
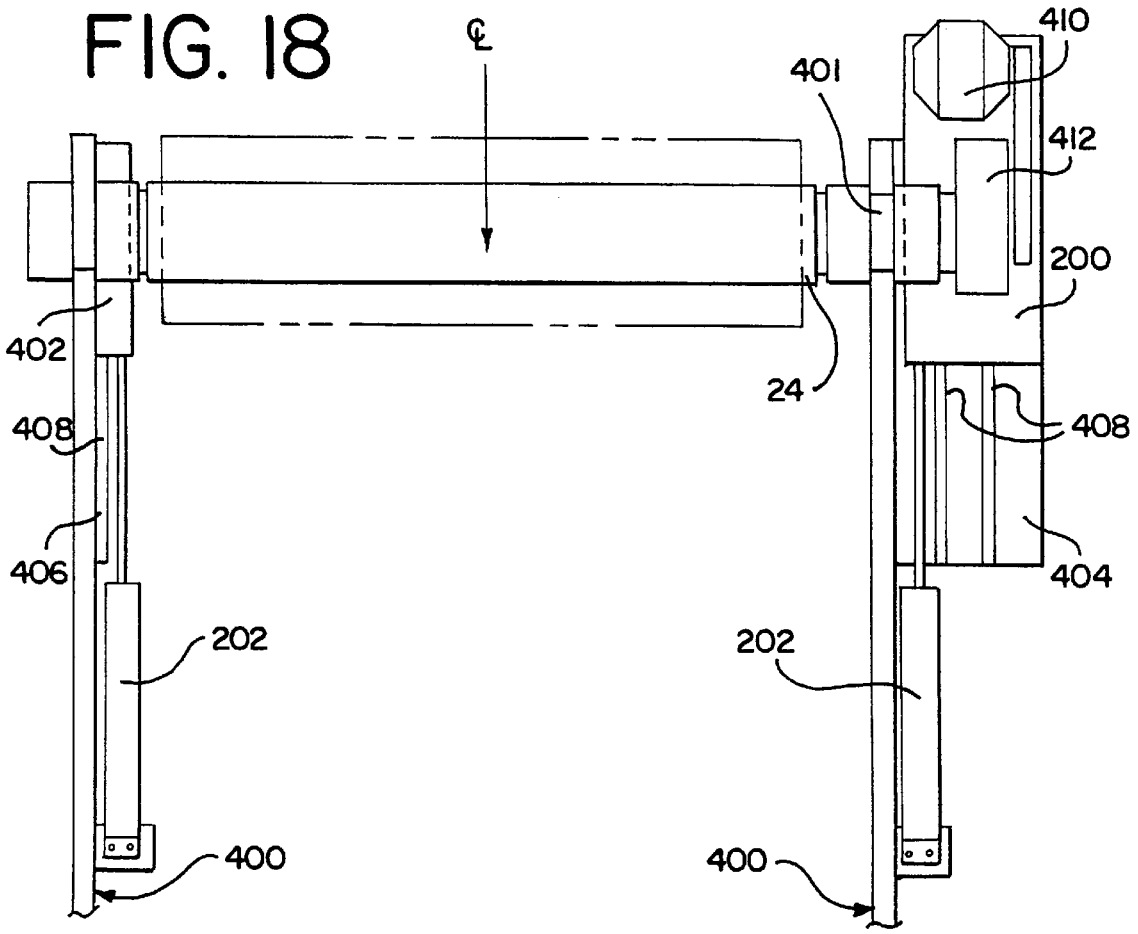
FIG. 18 is a partial top view of the reel spool and winding drum shown in FIG. 17 with only one set of carriages shown and without the slitting device applied thereto.

Referring to FIG. 18, only one set of carriages is shown for the purposes of simplicity, but it should be understood that the apparatus includes a duplicate pair of carriages and cylinders mounted opposite of the ones shown, i.e., in mirror image with a drive carriage positioned on the opposite outer side of the left hand rail (as viewed in FIG. 3), and a back carriage positioned on the inner side of the right hand rail (as viewed in FIG. 3). Both sets of carriages and cylinders are shown in FIG. 3. As shown in FIG. 17, each carriage member includes an upper portion 414 pivotally connected to a lower portion 416 with a hydraulic cylinder 418. In operation, the cylinder 418 is actuated to pivot the upper portion of the carriage members so as to receive the next reel spool as the other set of carriage members completes the winding cycle for the preceding roll. As the winding cycle is completed, the upper portion is pivotally lowered until the reel spool engages the rails and the reducer gear is extended to operably engage the reel spool. Meanwhile, after the roll and reel spool are removed from the rail and carriages, the carriages are pivoted downwardly by the cylinders, and cylinders 202 are extended so that the carriages may pass beneath the presently winding reel spool and be put in position to receive the next reel spool.

Figure 2:
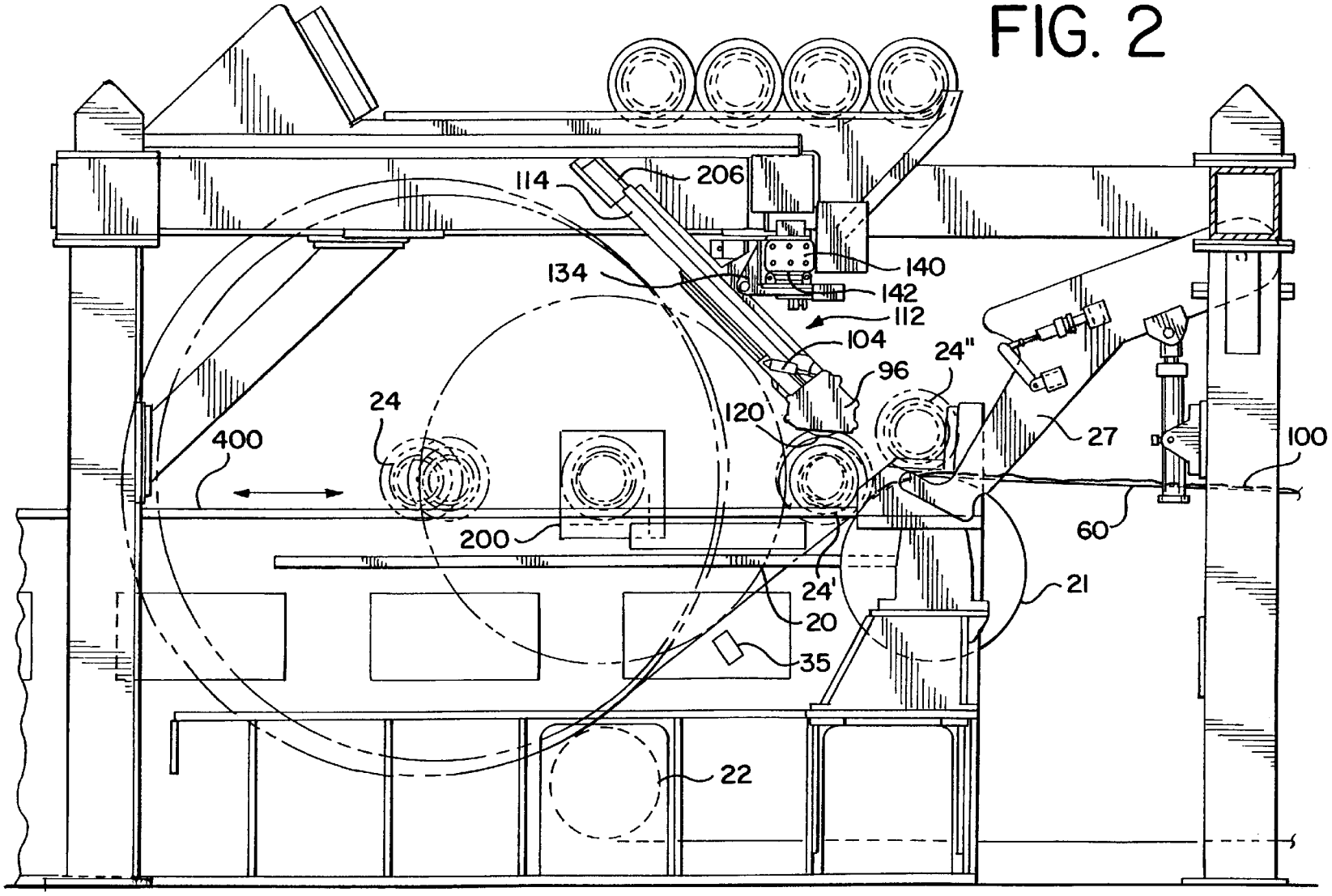
FIG. 2 is a side view of the slitting apparatus applied to a roll of sheet material web.
Figure 16:
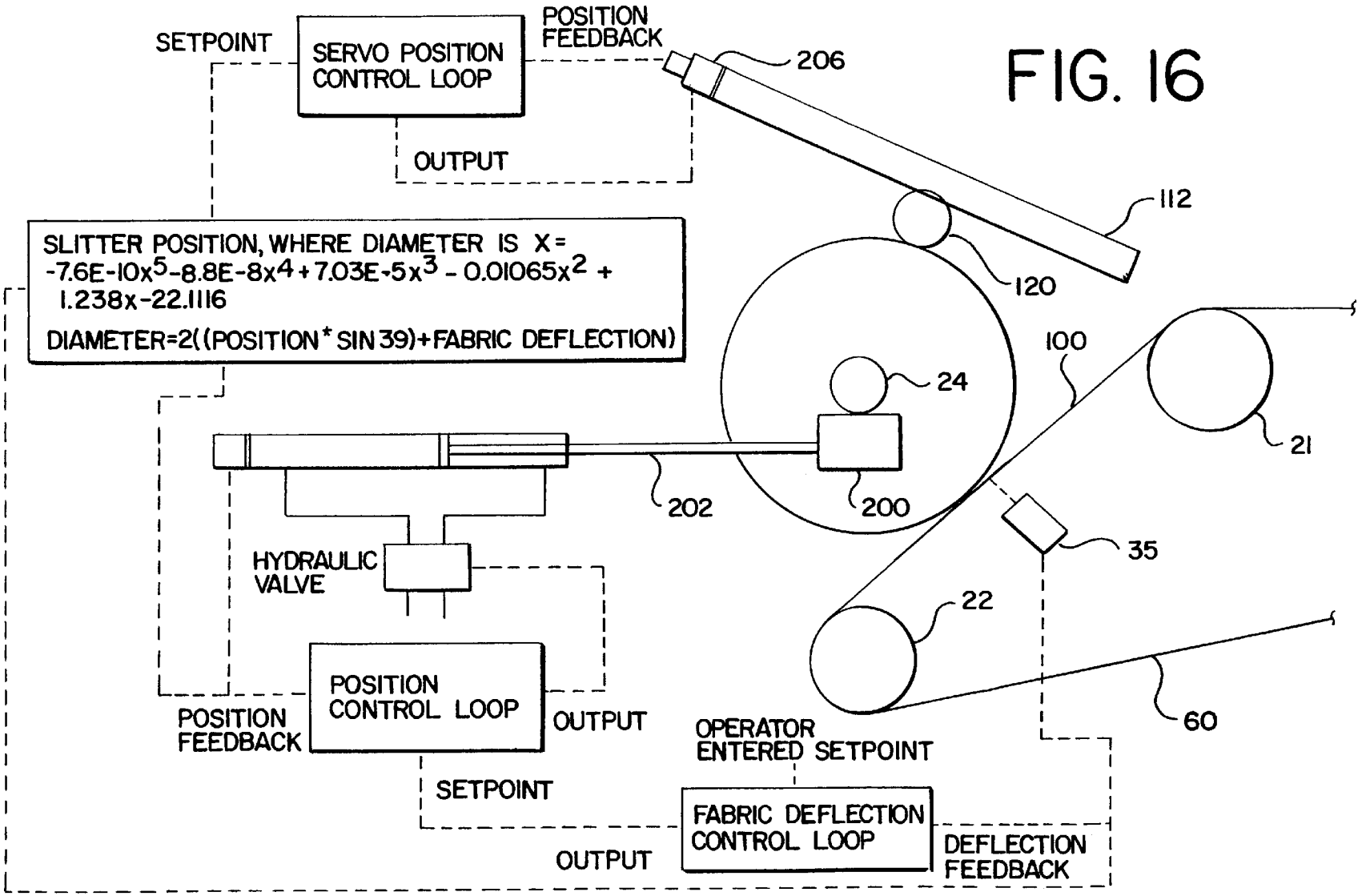
FIG. 16 is a schematic diagram of the control system for the slitting device.

Referring to FIGS. 2 and 16, control of the relative positions of the reel spool 24 and the transfer belt is suitably attained using a non-contacting sensing device 35 which is focused on the inside of the transfer belt, preferably at a point midway between the two winding drums as shown. The object is to minimize and control the pressure exerted by the parent roll against the sheet supported by the transfer belt as well as minimize the nip length created by the contact. The sensing device 35, such as a laser displacement sensor, detects changes in transfer belt deflection of as small as 0.005 inches. If the amount of deflection is outside a predetermined acceptable range, the sensor signals that the reel spool 24 of the parent roll be repositioned accordingly. It has been found that optimal winding operation for soft, high bulk tissue sheets is attained when the transfer belt deflection is maintained between about 2 to about 6 millimeters. Maintaining the transfer belt deflection within this range has been found to allow the parent roll and the transfer belt to operate with a relative speed differential without significant power transfer. This will allow control of the winding process to maintain substantially constant sheet properties throughout the parent roll.

Once the transfer belt deflection has been measured, a proportional only control loop maintains that deflection at a constant level. The output of this control is the setpoint for a hydraulic servo positioning control system for carriages 200, 402 supporting the building parent roll 20. When the transfer belt deflection exceeds the setpoint, the carriage position setpoint is increased, moving the carriages 200, 402 away from the fabric 60 to return the deflection back to the setpoint. A specific hydraulic servo positioning system consists of Moog servo valves controlled by a Allen-Bradley Programmable Logic Controller ("PLC"), Part No. 5/40L, with a QB module and with Temposonic linear voltage transducers mounted on the rods of the hydraulic cylinders 202 to determine the position of the axis of the reel spool. The output from the deflection control loop is the input to two individual servo positioning systems on either side of the reel 24. Each system can then control the hydraulic cylinders 202, keeping the two sides of the reel parallel. Preferably, a protection system stops the operation if the parallelism is lost, but it is not necessary to have an active system to keep the two sides parallel.

Figure 4:
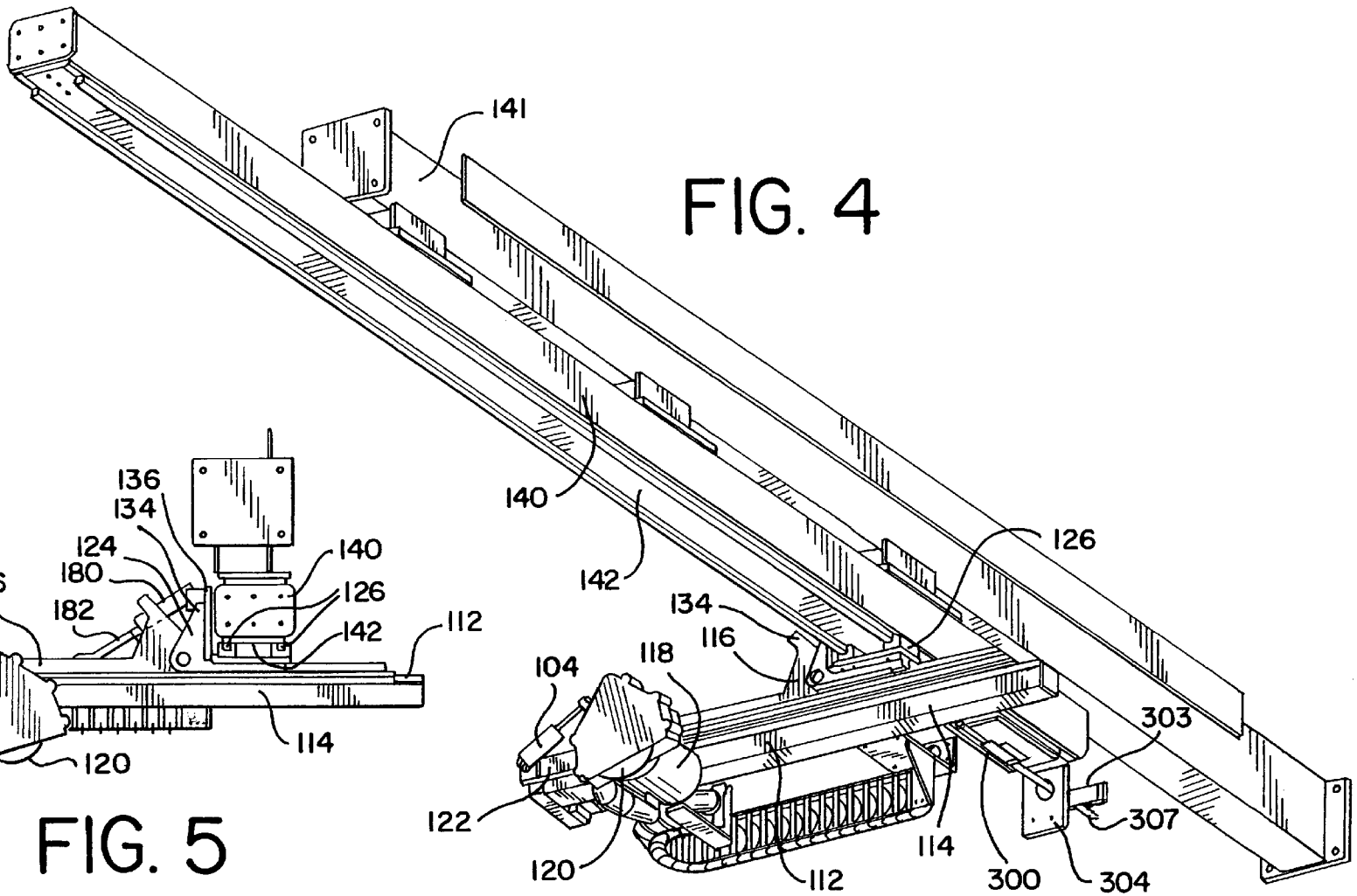
FIG. 4 is a perspective view of a slitting device including a track member mounted on a support member.
Figure 5:
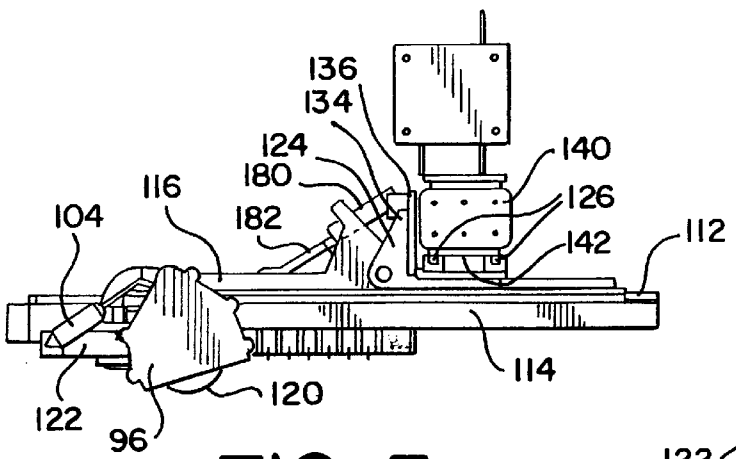
FIG. 5 is a side view of the slitting device with the track member in an upright horizontal position.
Figure 6:
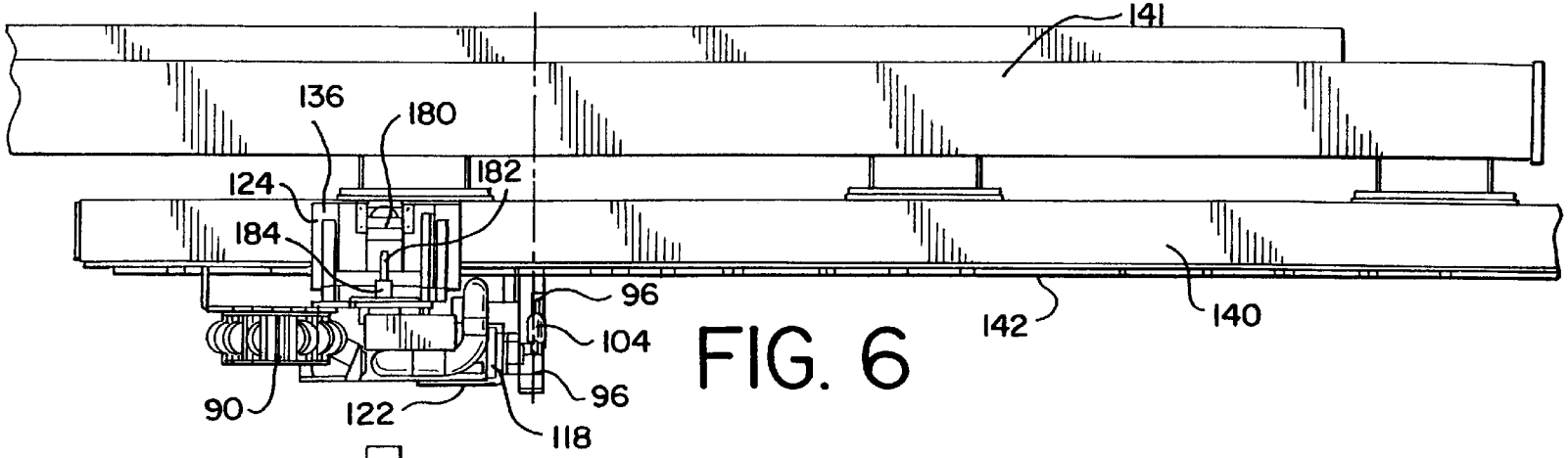
FIG. 6 is a front view of the slitting device shown in FIG. 5.
Figure 7:
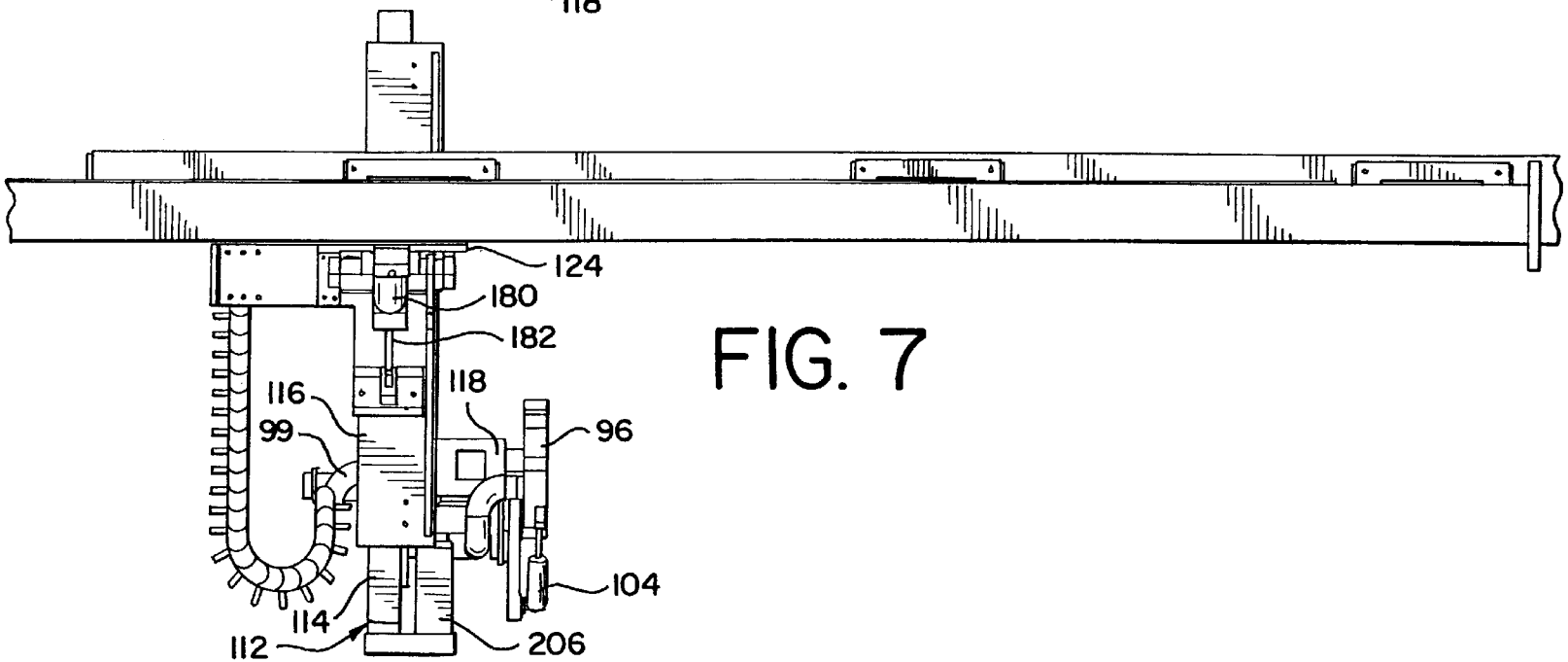
FIG. 7 is a top view of the slitting device shown in FIG. 5.
Figure 8:
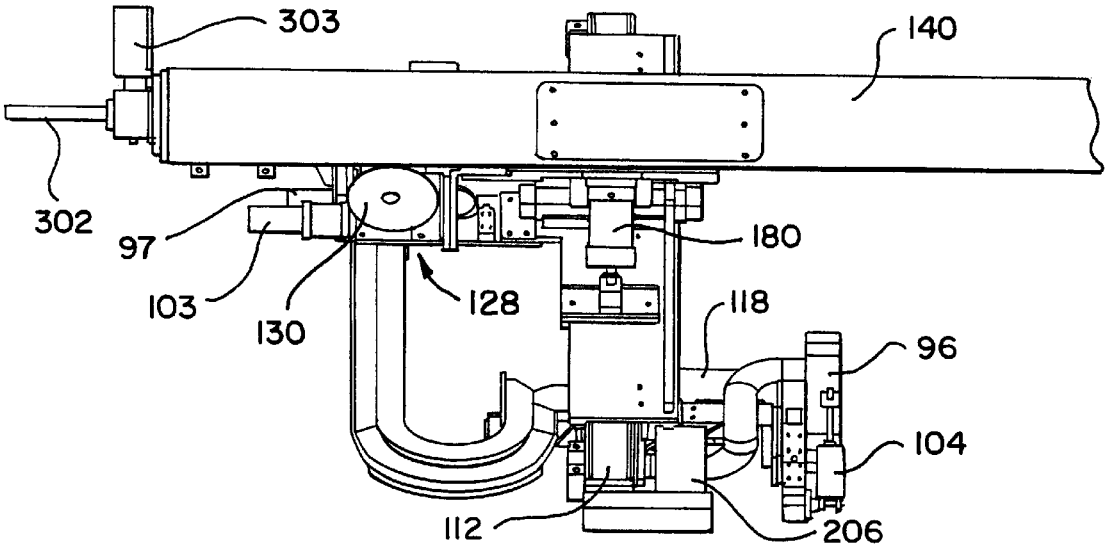
FIG. 8 is a top view of the slitting device with the track member in an angled operating position.

Referring now to FIGS. 2–10, and 13, one embodiment of the slitting apparatus is shown as including a slitting device having track member 112 with an elongated housing 114, an elongated screw 204 rotatably mounted in said housing, as shown in FIG. 13, and a slide member 208 slideably mounted to the housing. As shown in FIGS. 6–8, a servo drive motor 206 is mounted adjacent one end of the housing and is operably connected to an end of the screw, which extends from an end of the housing, with a belt, or like device. A commercially available track member is the STAR Linear Module MKK 25-110 available from Star Linear Systems in Charlotte, N.C.

Referring to FIGS. 4 and 7, a motor 118 and slitting member 120, preferably a rotary saw-toothed blade, are mounted to a support bracket 122 which is bolted to the slide member 208. The slitting member 120 is rotatably connected to the motor 118, which is mounted to the bottom of the support bracket. Use of a saw toothed blade avoids the need to sharpen the blade, which is important for various safety reasons. A commercially available saw blade suitable for use is the 1 inch inner diameter, 12 inch outer diameter tool steel blade sold by Heinemann Saw Co. as Part No. Schedule 456-A. Preferably, the saw blade rotates clockwise, or in the same direction as the travel of the fabric and sheet material web, and a greater speed, preferably at about a 2:1 ratio. In a preferred embodiment, the sheet speed is about 5,000 ft/min, while the blade rim speed is about 11,300 ft/min.

Alternatively, the slitting member can be configured as one of a stationary moveable knife blade, a water jet, a laser or any other known and conventional slitting device.

Figure 10:
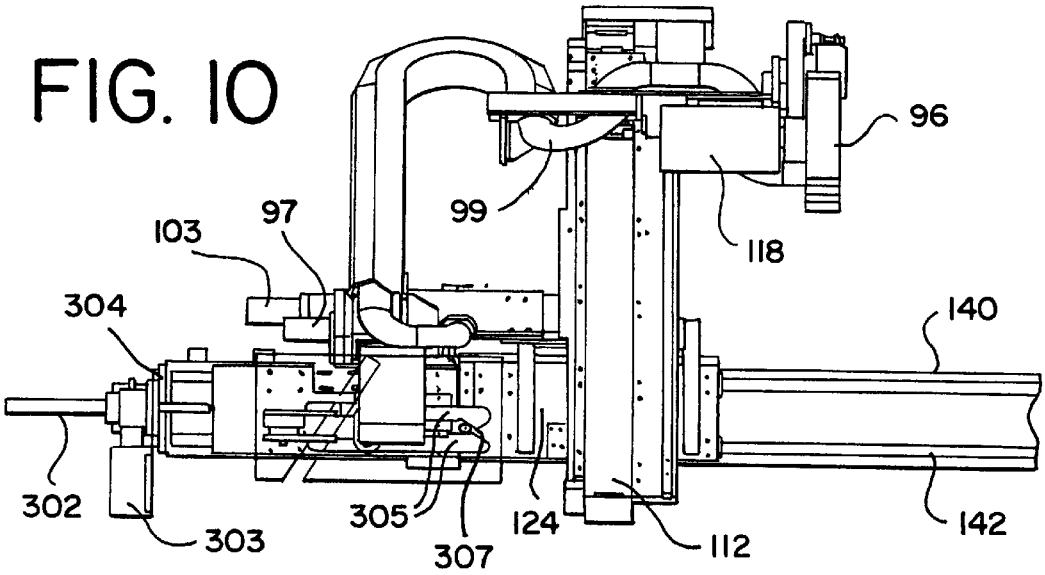
FIG. 10 is a bottom view of the slitting device shown in FIG. 8.
Figure 9:
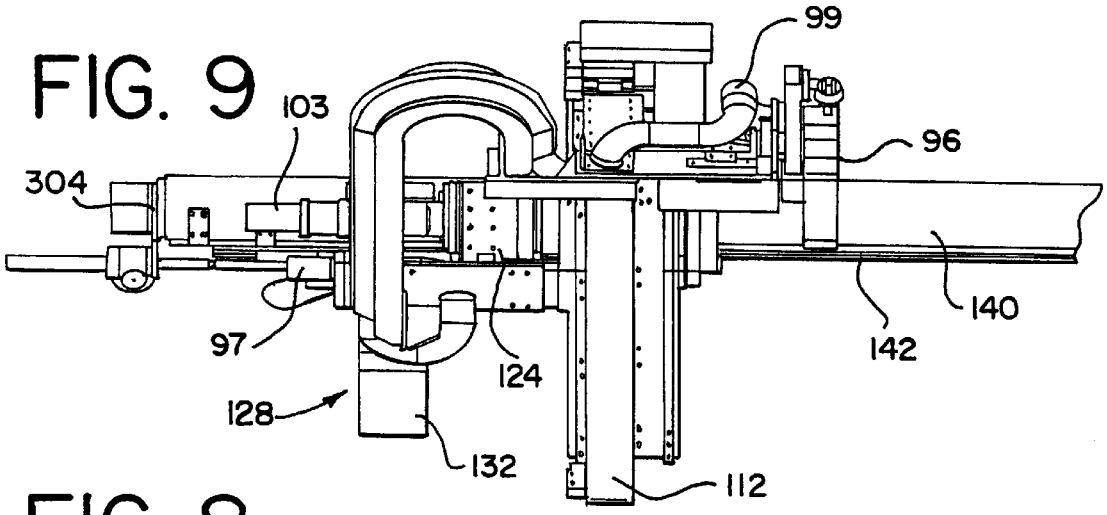
FIG. 9 is a front view of the slitting device shown in FIG. 8.

As shown in FIG. 11, a guard 96 is disposed around the saw blade 92 to shield the blade from the operator. A vacuum can be applied to the guard 96, which forms a housing around the blade, to suction away the dust created by the slitting operation. As shown in FIGS. 8–10, a conventional vacuum is attached at port 97, which is connected to the guard 96 with conduit 99. As shown in FIG. 12, a plate member 98 having a V-shaped mouth 102 is mounted to the bottom of the guard to increase the air velocity of the vacuum applied adjacent the blade. The mouth 102 is tapered so that it has a larger opening at the trailing edge of the mouth which allows for a relatively large amount of dust and fiber to pass through the mouth when the slitting member is actuated to make a plunge cut in the roll. A lubrication mist can also be applied to keep the blade clean.

As shown in FIGS. 5, 8 and 11, the guard 96, or housing, is pivotally connected to the support bracket 122. A pneumatic cylinder 104, preferably a gas spring, or air cylinder, interconnects the guard and support housing. In operation, the cylinder 104 is actuated to rotate the guard 96 about a pivot axis so as to change the angular position of the guard in relation to the building roll.

As illustrated in FIGS. 4–10, a support bracket 116 is mounted to the top of the track member and is pivotally attached to a carriage 124 at a horizontal pivot axis. The carriage 124 is moveably supported on a bottom of a cross member 140, preferably mounted to an overhead support structure or beam 141. It should be understood by one of skill in the art that the carriage could also be moveably mounted directly to the support structure. As best shown in FIGS. 4, 9 and 10, the cross member 140 includes a track 142 running along the length of the bottom surface of the cross member. Referring to FIG. 5, a pair of guides 126, or linear bearings, interface between the carriage 124 and track 142. As shown in FIGS. 8 and 9, A drive device 128, preferably including a drive motor 132 and wheel 130, extends outwardly from the carriage and engages a front surface of the cross member. It should be understood that the drive device, and wheel, could also be positioned to operably engage the underlying track, or the rear surface of the cross member. In operation, the motor 132 is actuated to drive the wheel 130 and thereby propel the carriage 124 along the length of the cross member. Preferably, the motor is air operated and is operably connected with an appropriate air supply at port 103. In this way, the carriage, and attached slitting member, can be moved laterally to a desired slitting position above the roll, or can be brought to the side of the machine where the operator or mechanic can service the slitting device, or change the saw blade thereon. Alternatively, it should be understood that the carriage can be moved along the track in any number of conventional and well known ways, such as by a chain drives, belts, gears and like devices.

Preferably, when being moved laterally from a centered slitting position to a side maintenance position adjacent the operator, the track 112 is pivoted into the upright horizontal position so as not to interfere or collide with the overlying support structure. In addition, the slitting member 120 is thereby positioned away from the underlying roll or reel spool so as to avoid any inadvertent contact and attendant damage. Proximity switches are installed on the slitting device and/or track system and must be activated in order to permit further lateral travel of the slitting device along the track.

When positioned at the preferred slitting or operating position overlying the roll, a further lateral adjustment mechanism includes a trolley member 300 mounted on a bottom of the cross member and connected to the carriage as shown in FIGS. 8–10. Referring to FIG. 10, the trolley member 300 includes a pair of pneumatically controller fingers 305 which are actuated to engage a pin 307 extending from the carriage 124. A screw jack 302 is rotatably connected to a bracket 304 extending downwardly from the cross member and threadably engages the trolley 300. A motor 303 is operably connected to the screw jack and can be controlled to rotate the screw and thereby move the trolley and attached carriage linearly along the track. Alternatively, the screw jack can be manually operated and manipulated to move the carriage laterally along the overlying track. Preferably, the screw jack 302 provides the trolley 300, and atttached carriage, with ±2 inches of linear travel from the center line of the desired slitting position. The motor and screw can be manipulated so as to maintain with great accuracy the lateral position of the slit within the roll.

As shown in FIGS. 2 and 5, a stop member 134 extends upwardly from bracket member 116 adjacent the horizontal pivot axis. A pneumatic cylinder 180 is pivotally connected to a plate member 136 extending upwardly from a forward portion of the carriage. A piston rod 182 extends downwardly and forwardly from the cylinder and includes an end 184 pivotally connected to the bracket member 116. Preferably, the pneumatic cylinder is a gas spring, or air cylinder, which is less likely to leak fluids or oils, although it should be understood that hydraulic cylinders would also work. When retracted, the cylinder pivots the bracket and attached track about the pivot axis so as to position the track in a, transverse and spaced apart tangential relationship with the roll below. Preferably, the track is maintained at a relatively constant distance from the surface of the roll as the roll increases in diameter and moves away from the winding drum. In operation, the stop member 134 engages the plate member 136 to prevent the track member from pivoting too far towards the roll of sheet material web, and more specifically the reel spool, underlying the slitting member. In addition, proximity switches (not shown) can be installed on the track and carriage. In operation, the proximity switches must be triggered either to signal that the track is in the upright horizontal position and is therefore ready for lateral travel along the cross member, or to signal that the track is in the angled operating position and is therefore ready for operation.

In operation, and as diagrammed in FIG. 16 and shown in FIGS. 2–3 and 17–18, the pneumatic cylinder 180 is retracted to pivot the track from an upright horizontal position to the preferred tangential operational position, and the proximity switches are triggered so as to allow the slitting operation to begin. Meanwhile, the sheet 100 is transferred to the reel spool 24 as explained above and is rotatably deposited thereon. After a predetermined number of layers of sheet material web have been applied to the roll, or a predetermined thickness or diameter of the roll has been reached, usually in the range of about 1–2 inches of material, a digital servo controller receives a signal to actuate the servo drive motor 206 which rotates the screw 194 and thereby moves the slide member and attached support bracket 122 and slitting member toward the reel spool 24 to make a plunge cut in the roll. The controller is then signaled to actuate the servo drive motor 206 to move the slitting member 120 away from the roll until a predetermined penetration of the saw blade is reached within the roll. During these operations, only the slitting member, or blade, contacts the roll; neither the control system nor the track member contacts the outer surface of the roll. Similarly, the blade is preferably configured without an attached guide or pressure roller, which are typically used to control the depth of penetration. Indeed, the preferred plunge cut may not be possible with such a configuration, or in any other embodiment where the blade is mechanically linked to a roller or similar device contacting the outer surface of the roll. Accordingly and preferably, the only other contact with the roll, besides the blade, is at the nip where the fabric first applies the sheet material web to the roll.

As the roll 20 builds, the reel spool 24 moves away from the winding drum 21 as explained above. As the reel spool moves, corresponding to the parent roll building in diameter and size, an output signal from the position sensors on the hydraulic cylinders 202, which directly corresponds to the position of the axis of the reel spool, serves as the setpoint for the servo position control loop and the servo controller operably connected to the servo drive motor and track. A suitable servo controller is the 1394 controller module available from Allen-Bradley. The servo position drive on the track interfaces with the PLC controller with a 4 to 20 milliamp linear signal, with 4 milliamps corresponding to the minimum zero displacement of the slitting member along the track at its starting position and 20 milliamps corresponding to a maximum 60 inch displacement of the slitting member. In response to the signal from the PLC controller corresponding to the position of the reel spool, the controller signals the motor to move the slide member so as to maintain a predetermined penetration of the slitting member within the roll. Alternatively, the radius or thickness of the roll 20 can be determined by direct measurement, and can serve as an input for the controller.

In the preferred embodiment, the diameter of the roll is known by means of the relative position of the reel spool shaft from it initial starting position and the transfer belt deflection. As just described, the PLC controller is programmed to receive an input corresponding to the position of the hydraulic cylinders, which determines the relative position of the reel spool shaft, and then signals the servo drive to actuate the motor and track to move the slitting member within the track to maintain the desired penetration. A computer can be programmed and used to interface with the controllers, and thereby adjust the desired depth of penetration using the same control concepts.

Preferably, when the roll reaches about one half of its final size, or about 68 inches for a 140 inch roll, the slitting member 120 has moved upwardly within the track 112 so that the mouth 102 of the guard is no longer at an approximate tangent to the roll, which is the preferred orientation. At this point, the PLC signals the cylinder 104 to rotate the guard and thereby alter the exposure of the blade for the remainder of the slitting operation. Proximity switches are installed in the guard 96, and must be triggered by the rotation of the guard in order for the upward and downward movement of the slitting member on the track to continue.

Preferably, the track 112 is pivoted into an operational position at an angle of about 43.6 degrees from the horizontal position such that the track forms a path parallel to and spaced apart at a relatively constant distance from an approximate tangent of the outer surface of the roll as it builds in size. In this way, the slitting member 120 need only be translated within the track 112 as it continuously slits the building roll. However, it should be understood that the track could be simultaneously pivoted as the slitting member is translated, or that both motions be actuated together or alone, so as to maintain the proper depth of penetration of the slitting member within the roll.

As illustrated in the FIG. 3, an electrical harness 190 electrically connects an operator station 192 with the carriage 124 and attached slitting device. In this way, the servo controller and motor are connected with the reel spool control system, so as to control the movement of the support bracket along the track. The retraction of the pneumatic cylinder and the movement of the carriage on the cross member track can similarly be controlled.

Figure 15:
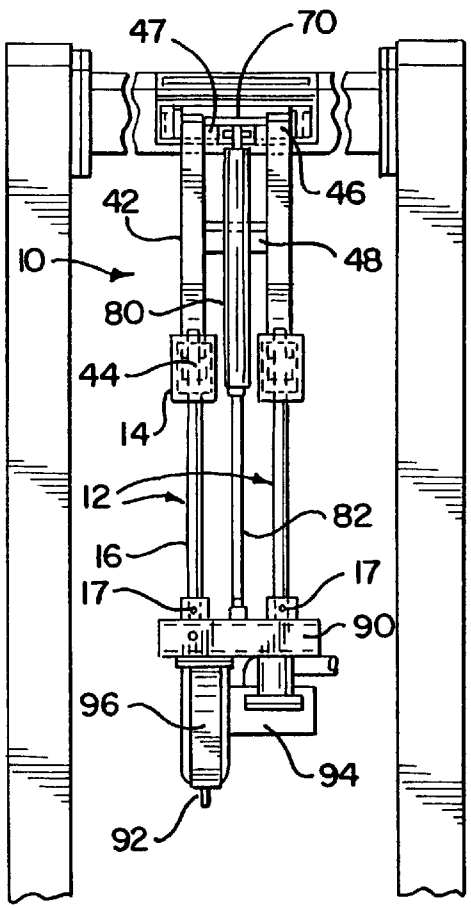
FIG. 15 is a rear view of the slitting apparatus of FIG. 14.
Figure 14:
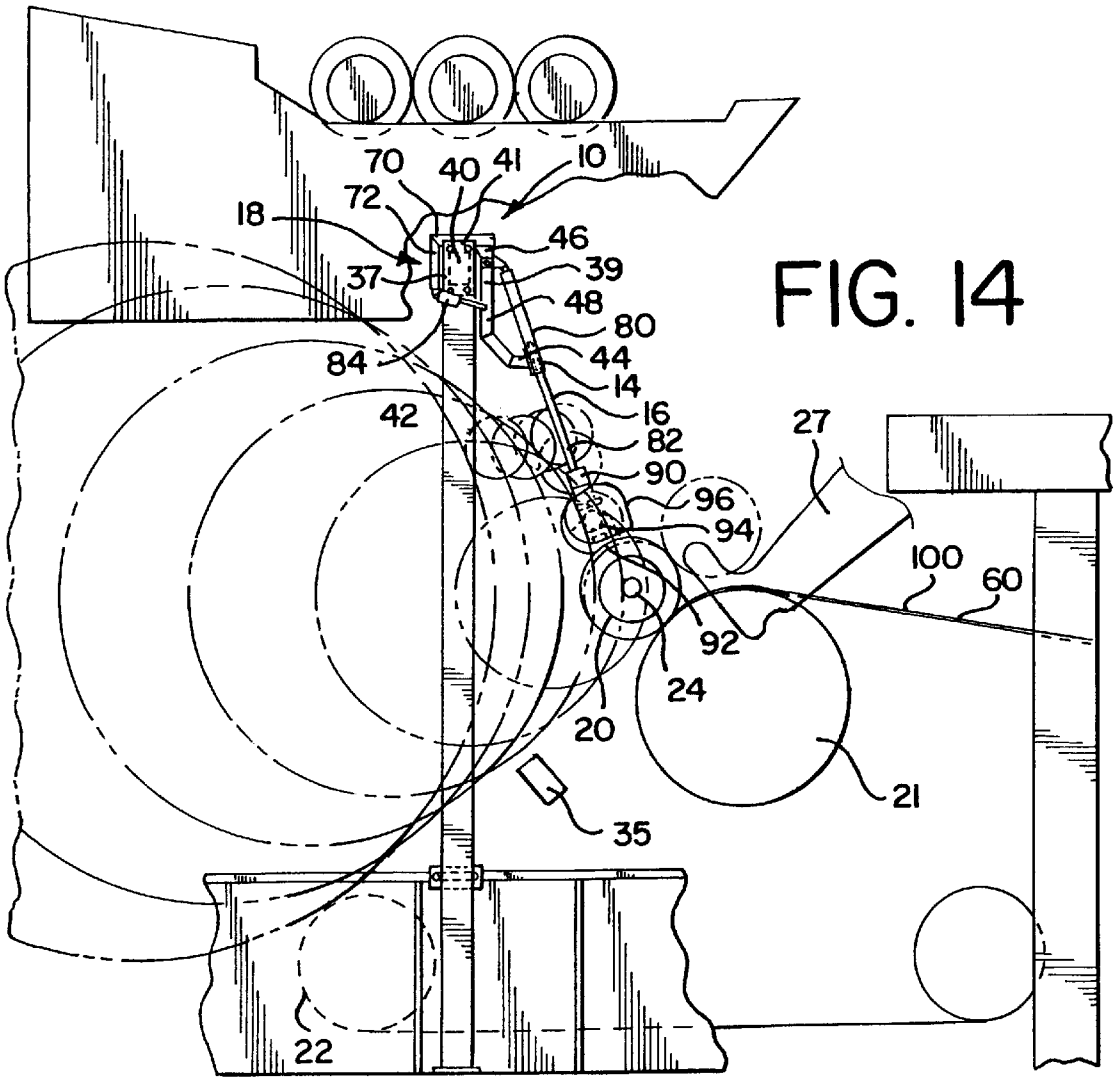
FIG. 14 is a side view of an alternative embodiment of the slitting apparatus.

Referring to FIGS. 14–15, an alternative embodiment of the slitting apparatus 10 has a slitting device 18 mounted to a support member 40. The slitting device includes a pair of tracks 12 having a guide member 14 and a slide member 16 slideably received in the guide member. Each guide member 14 is mounted to an end 44 of a downwardly extending arm member 42, which has an opposite end 46 pivotally connected to a carriage 70. The arm members 42 are laterally spaced apart and connected with a cross member 48. The carriage 70 is either mounted to or moveably supported on the support member 40. The support member is preferably configured as a cross member supported on opposite ends thereof over the path of the sheet material web and underlying roll of sheet material. The arm portions 42 extend downwardly from the carriage along a rear surface 39 of the cross member.

As shown in FIGS. 14 and 15, a hydraulic cylinder 80 is pivotally attached to the carriage 70 about a horizontal pivot axis. A piston rod 82 extends downwardly from the cylinder and is attached to a support bracket 90. A lower end 17 of each slide member is also attached to the support bracket. A slitting member 92, preferably a rotary saw-toothed blade, is rotatably connected to a motor 94, which is mounted to the bottom of the support bracket. Alternatively, the slitting member can be configured as one of a stationary moveable knife blade, a water jet, a laser or any other known and conventional slitting device.

Preferably, as described above, a guard 96 is disposed around the saw blade 92 to shield the blade from the operator. Preferably, a vacuum is applied to the guard, which forms a housing around the blade, to suction away the dust created by the slitting operation. A lubrication mist can also be applied to keep the blade clean.

As shown in FIG. 15, a second hydraulic cylinder 84 is pivotally attached to a forward portion 72 of the carriage at a horizontal pivot axis. The forward portion 72 extends downwardly adjacent a forward surface 37 of the cross member. The cylinder 84 extends rearwardly from the forward portion of the carriage and is pivotally attached to an approximate midpoint of the lower cross member 48, which interconnects the arm members.

In operation, the cylinders 80, 84 are extended to engage the roll with the slitting member. Preferably, a plunge cut is made to slit the initial layers of sheet material web already deposited on the roll. As the roll 20 builds, the reel spool 24 moves away from the winding drum 21 as explained above, and a controller retracts cylinder 80 so as to maintain a predetermined penetration of the saw blade within the roll as it builds in size. In particular, the cylinder 80 retracts the piston rod 82 so as to translate the slide members within the guide members in a substantially linear direction so as to thereby move the slitting member to maintain the predetermined depth of penetration. As the roll continues to build, and as the reel spool 24 continues to move away from the winding drum, the controller is further signaled to actuate the second cylinder 84 to pivot the arm members 42 and attached slitting member about the horizontal pivot axis. During this pivotal movement, the slide members are preferably maintained at a fixed position relative to the guide member, so as to maintain the predetermined depth of penetration. Although the steps of actuation or retraction of the first and second cylinders have been described as being consecutive in operation, it should be understood that the cylinders could be simultaneously actuated so as to simultaneously pivot and translate the slitting member so as to maintain the desired predetermined depth of the slitting member within the roll. The hydraulic cylinders are controlled in the same manner as the cylinders in the previous embodiment with position control loops.

The slitting apparatus and method of slitting provides significant advantages. First, the invention provides for supporting the web on a fabric between the dryer and the winding drum, which allows the manufacturer to do away with open draws. Accordingly, sheet breaks and the like are reduced, while simultaneously allowing for the manufacture of a softer, more desirable sheet material product. In addition, the invention eliminates the need for wet slitting which helps to preserve the throughdrying fabric, improves the control of sheet web and provides a more uniform web. Moreover, the lateral position of the slitting apparatus can be easily adjusted and changed, either to vary the position of the slit or to move the slitting device to the operator for service.

Furthermore, the invention allows for the web to be slit on the roll, such that the web being slit is supported by underlying layers of web which results in a cleaner, improved cut. Moreover, since each layer is slit after it is applied to the roll, the invention eliminates the problem of interweaving between the separate strips of sheet material web. As such, the finished rolls can be easily separated and removed from the reel spool.

Additionally, the preferred invention includes a single track overlying the roll, with the slitting device moveably mounted on the track member. By using a single track, as opposed to a pair of tracks positioned on opposite sides of the roll, the apparatus is greatly simplified and allows for the track and slitting device to be moved easily to the desired cutting position. Moreover, the single track avoids the possibility of binding between opposite side supports, and reduces the number of parts which must be installed and maintained.

The invention also provides a slitting device whose position is not linked to or controlled by the outer surface of the building roll. Accordingly, the slitting member can be easily programmed to make a plunge cut after a predetermined depth is reached on the building roll, but without compressing the roll adjacent the cut. The programmable control system also provides for the ability to make a plunge cut, but without a complicated and expensive mechanism. Moreover, the depth of penetration of the slitting member can be controlled without a guide roller contacting the outer surface of the roll which is important when slitting sheets of tissue, which have relatively low densities and cannot adequately support a guide roller or like stop device due to their relative inability to resist compressive forces. By providing a control system that does not key off of the surface of the roll, or otherwise contact it, but rather programmably links the reel spool and slitter member, the sheet material web is less likely to be damaged and a more reliable depth of penetration is maintained. That is because it is only the slitting member, or blade component of the slitting device which contacts the roll, not the track, control system or carriage, or any type of guide or pressure roller attached to the blade or applied separately to the roll.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. An apparatus for slitting a sheet material web on a roll, said apparatus comprising:

at least one winding drum adapted to support said sheet material web, said at least one winding drum having a first axis of rotation;

a moveable reel spool positioned in a parallel, spaced apart relationship with said at least one winding drum and having a second axis of rotation substantially parallel to said first axis of rotation, said reel spool adapted to receive said sheet material web so as to form a roll of sheet material web having an outermost layer and characterized by a diameter as said sheet material web is rotatably deposited on said reel spool so as to thereby increase the diameter of the roll of sheet material web thereon, said reel spool moveable between a plurality of positions as the diameter of the roll increases;

a slitting device comprising a slitting member moveably mounted relative to said reel spool and adapted to penetrate at least the outermost layer of said roll so as to continuously slit said sheet material web as it is wound onto said roll;

a control system operably connecting said slitting device and said reel spool, said control system operative to determine a position of the reel spool as said reel spool moves between said plurality of positions and further operative to send a signal to said slitting device corresponding to the position of said reel spool, said slitting device operative to move said slitting member relative to said reel spool in response to said signal so as to maintain a penetration of the slitting member within the roll as said slitting member penetrates at least the outermost layer of said roll as said roll increases in size, whereby said control system controls the penetration of said slitting member within said roll independent of any contact with an outer surface of said roll.

2. The apparatus of claim 1 wherein said slitting device further comprises a track member, wherein said slitting member is moveably mounted on said track member and wherein said control system is adapted to move said slitting member on said track member.

3. The apparatus of claim 2 wherein said track member is pivotally mounted to a support member.

4. The apparatus of claim 2 wherein said control system comprises a controller adapted to receive said signal corresponding to the position of the reel spool and move said slitting member on said track member to a desired position in response to said signal so as to thereby maintain said penetration of said slitting member within said roll.

5. The apparatus of claim 2 wherein said slitting device further comprises a carriage moveably mounted on a laterally extending cross member, and wherein said track member is mounted on said carriage.

6. The apparatus of claim 5 wherein said cross member is characterized by a length, and wherein said carriage comprises a drive device adapted to propel said carriage along the length of said cross member.

7. The apparatus of claim 6 wherein said drive device comprises a wheel operably engaging said cross member.

8. The apparatus of claim 5 wherein said slitting device further comprises an actuator pivotally attached to and extending between said track member and said carriage, whereby retraction and extension of said actuator causes said track member to pivot about an axis substantially parallel to said first and second axis.

9. The apparatus of claim 2 wherein said slitting device comprises a motor mounted to a support bracket and wherein said slitting member comprises a rotary saw blade rotatably mounted to said motor, said support bracket slideably mounted to said track member.

10. The apparatus of claim 9 wherein said slitting device further comprises a guard disposed around said saw blade, said guard having a mouth adapted to open towards said roll, and said saw blade extending through said mouth.

11. The apparatus of claim 10 wherein said guard comprises a plate member attached to said guard, said plate member having a V-shaped mouth adapted to open towards said roll.

12. The apparatus of claim 10 wherein said guard is pivotally connected to said support bracket.

13. The apparatus of claim 1 wherein said slitting device further comprises a track pivotally mounted on a support member, said track comprising a guide member and a slide member slideably received in said guide member, wherein one end of said slide member is mounted to a support bracket, and wherein said slitting member is mounted to said support bracket, an actuator comprises a first end attached to said support bracket and a second end attached to said support member, and wherein said control system is operative to retract and extend said actuator, whereby said retraction and extension of said actuator causes said slide member to slideably move within said guide member so as to thereby move said slitting member with respect to said roll and maintain the desired penetration of said slitting member within said roll.

14. The apparatus of claim 13 wherein said slitting member comprises a rotary saw blade and wherein said slitting device further comprising a motor mounted on said support bracket, said motor operably connected to said rotary saw blade.

15. The apparatus of claim 1 wherein said slitting device further comprises a support bracket and a track member comprising a housing having a screw rotatably mounted therein, said screw threadably engaging a slide member, and wherein said support bracket is mounted on said slide member and said slitting member is mounted on said support bracket, whereby rotation of said screw causes said slide member and said slitting member to move along said track.

16. The apparatus of claim 15 wherein said slitting member comprises a rotary saw blade and wherein said slitting device further comprises a motor mounted on said support bracket, said motor operably connected to said rotary saw blade.

17. The apparatus of claim 15 wherein said housing is pivotally attached to a support member and comprises a stop member adapted to limit the pivotal movement of said track member about said support member.

18. The apparatus of claim 2 wherein said track member overlies and is adapted to be positioned in a spaced apart tangential relationship with said roll as said roll increases in size.

19. An apparatus for slitting a sheet material web on a roll characterized by a diameter, said apparatus comprising:

at least one winding drum adapted to support said sheet material web;

a moveable reel spool positioned in a parallel, spaced apart relationship with said at least one winding drum and adapted to be moved away therefrom as said sheet material web is rotatably deposited on said reel spool so as to thereby increase the diameter of the roll of sheet material web thereon, said reel spool having a first horizontal axis of rotation;

a horizontal cross member spaced apart from said at least one winding drum and said reel spool in a substantially parallel relationship therewith;

a slitting device comprising a carriage, a track member pivotably mounted to said carriage about a second horizontal axis of rotation spaced apart from said first horizontal axis, and a slitting member moveably mounted on said track member and adapted to continuously slit said sheet material web as it is wound onto said roll, wherein said track member is characterized by a length extending transverse to said first and second horizontal axis of rotation, said slitting device moveable along said length toward and away from said second horizontal axis of rotation, and wherein said carriage is moveably supported on said cross member, whereby said carriage can be moved laterally along said cross member relative to said roll of sheet material web.

20. The apparatus of claim 19 wherein said carriage comprises a drive device adapted to propel said carriage along said cross member.

21. The apparatus of claim 19 wherein said slitting device comprises an actuator pivotally attached to and extending between said track member and said carriage, whereby actuation of said actuator causes said track member to pivot about a pivot axis.

22. The apparatus of claim 19 wherein said slitting member comprises a rotary saw blade rotatably mounted to a support bracket, said support bracket slideably mounted to said track member.

23. The apparatus of claim 19 wherein said track member comprises a guide member connected to said carriage and a slide member slideably received in said guide member, wherein one end of said slide member is mounted to a support bracket, said slitting member also mounted to said support bracket, an actuator comprises a first end attached to said support bracket and a second end attached to said carriage, whereby said retraction and extension of said actuator causes said slide member to slideably move within said guide member so as to thereby move said slitting member with respect to said roll and maintain the desired penetration of said slitting member within said roll.

24. The apparatus of claim 23 wherein said slitting member comprises a rotary saw blade and wherein said slitting device further comprising a motor mounted on said support bracket, said motor operably connected to said rotary saw blade.

25. The apparatus of claim 19 wherein said slitting device further comprises a support bracket and said track member comprises a housing, wherein said support bracket is slideably mounted on said housing, and wherein said slitting member is mounted on said support bracket.

26. The apparatus of claim 25 wherein said slitting member comprises a rotary saw blade and wherein said slitting device further comprising a motor mounted on said support bracket, said motor operably connected to said rotary saw blade.

27. The apparatus of claim 25 wherein said housing is pivotally attached to a support member and comprises a stop member adapted to limit the pivotal movement of said housing about said support member.

28. An apparatus for slitting a sheet material web on a roll, said apparatus comprising:

a reel spool adapted to receive the sheet material web as the roll is formed thereon, said reel spool having a first axis of rotation;

a track member characterized by a length overlying said reel spool in a spaced apart tangential relationship therewith, said length of said track member extending transverse to said axis of rotation of said reel spool, said track member pivotably mounted about a second axis of rotation parallel to said first axis of rotation of said reel spool;

a rotary slitting member rotatably mounted to a slide member, said slide member moveably mounted to said track member, said slide member moveable along at least a portion of the length of said track member toward and away from said second axis of rotation, said slitting member adapted to continuously slit said sheet material web as it is wound onto said roll.

29. A method for continuously slitting a sheet material web on a roll comprising:

carrying said sheet material web over a winding drum in a longitudinal direction;

depositing said sheet material web onto a rotating reel spool to form said roll of sheet material web;

moving said reel spool relative to said winding drum as additional layers of sheet material web are added to said roll so as to thereby cause said roll to increase in diameter, said reel spool having a position;

determining said position of said reel spool;

sending a signal to a slitting device corresponding to the position of said reel spool, said slitting device comprising a slitting member;

moving said slitting member in response to the signal corresponding to the position of the reel spool so as to slit said sheet material web on said roll and so as to maintain a penetration of said slitting member within said roll as additional layers of sheet material web are added to said roll.

30. The method of claim 29 further comprising the step of making a plunge cut with said slitting member to slit the roll after a predetermined diameter is reached.

31. The method of claim 29 wherein said step of moving said slitting member further comprises slideably moving said slitting member on a track member so as to maintain the predetermined depth of the slitting member within said roll as the reel spool moves away from the winding drum.

32. The method of claim 31 wherein said track member overlies said roll in a transverse, spaced apart tangential relationship.

33. The method of claim 31 wherein said step of moving said slitting device further comprises pivoting said track member so as to maintain the predetermined depth of the slitting device as the spool reel moves away from the winding drum.

34. The apparatus of claim 1 wherein said at least one winding drum comprises a first winding drum, and wherein a second winding drum is positioned in a spaced apart and parallel relationship with said first winding drum, and wherein a transfer fabric is supported by said first and second winding drums, said transfer fabric adapted to carry said sheet material web over said first winding drum and thereafter form a nip with said roll of sheet material web.

35. The apparatus of claim 34 wherein said transfer fabric is flexible and is characterized by a deflection of said transfer fabric as it is supported by said first and second winding drums in response to the force of the roll at said nip, and wherein said control system comprises a first control system, and further comprising a second control system operative to determine the amount of said deflection and to move said reel spool in response to said determination of said deflection so as to maintain the deflection within a predetermined range.

36. The apparatus of claim 35 wherein said second control system comprises a sensor positioned proximate said transfer fabric, said sensor operative to detect the deflection of said transfer belt and to send a signal to a controller operably connected to an actuator, said actuator operably connected to said reel spool, said actuator operative to move said reel spool in response to the signal received from said sensor so as to maintain the deflection within said predetermined range.

37. The apparatus of claim 36 wherein said actuator comprises at least one hydraulic cylinder operably connected to a valve system, wherein said controller controls said valve system so as to actuate said hydraulic cylinder and thereby move said reel spool.

38. The apparatus of claim 36 wherein said first control system further comprises a position sensor operably connected to said actuator, said position sensor generating an output signal corresponding to a position of said actuator and of said reel spool connected to said actuator, said output signal comprising said signal sent to said slitting device.

39. The method of claim 29 wherein said step of carrying said sheet material web further comprises carrying said sheet material web on a transfer fabric supported by a first and second winding drum, said transfer fabric forming a nip with said roll of sheet material web as said sheet material web is deposited thereon, and wherein said transfer fabric is flexible, and further comprising the steps of deflecting said transfer fabric as it is supported by said first and second winding drums in response to the force of the roll at said nip, determining the amount of the deflection of said transfer fabric, and moving the reel spool in response to said determination so as to maintain the deflection within a predetermined range.

40. The method of claim 39 wherein said step of determining the amount of the deflection comprises detecting the amount of deflection with a sensor, and wherein said step of moving the reel spool in response to said determination comprises sending a signal from said sensor to a controller and actuating an actuator with said controller to move said reel spool so as to maintain the deflection within a predetermined range.

* * * * *

UNITED STATES PATENT AND TRADEMARK OFFICE

CERTIFICATE OF CORRECTION

PATENT NO. : 6,098,510
DATED : August 8, 2000
INVENTOR(S) : Frank S. Hada et al.

It is certified that error appears in the above-identified patent and that said Letters Patent is hereby corrected as shown below:

Title page, column 2,
Line 6, delete "86 00 460 U" and substitute -- 86 00 460.3 -- in its place.
Line 9, delete "2 122 941" and substitute -- 2 122 941A -- in its place.
Line 6, under "OTHER PUBLICATIONS", after "1997)" insert -- (12 pg.) --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*